US007442113B2

(12) United States Patent
Berman et al.

(10) Patent No.: US 7,442,113 B2
(45) Date of Patent: Oct. 28, 2008

(54) VISUAL WEAR CONFIRMATION POLISHING PAD

(75) Inventors: Michael J. Berman, West Linn, OR (US); Matthew R. Trattles, Troutdale, OR (US)

(73) Assignee: LSI Corporation, Milpitas, CA (US)

( * ) Notice: Subject to any disclaimer, the term of this patent is extended or adjusted under 35 U.S.C. 154(b) by 886 days.

(21) Appl. No.: 10/421,421

(22) Filed: Apr. 23, 2003

(65) Prior Publication Data

US 2004/0214511 A1 Oct. 28, 2004

(51) Int. Cl.
*B24B 7/22* (2006.01)

(52) U.S. Cl. ..... 451/41; 451/533

(58) Field of Classification Search ..... 451/41, 451/36, 56, 72, 443, 444, 526, 527, 530, 451/533, 539, 327

See application file for complete search history.

(56) References Cited

U.S. PATENT DOCUMENTS

| | | | | |
|---|---|---|---|---|
| 5,736,427 | A * | 4/1998 | Henderson | 438/14 |
| 5,913,713 | A * | 6/1999 | Cheek et al. | 451/41 |
| 6,090,476 | A * | 7/2000 | Thysell et al. | 428/212 |
| 6,106,661 | A * | 8/2000 | Raeder et al. | 156/345.12 |
| 6,331,137 | B1 * | 12/2001 | Raeder et al. | 451/285 |
| 6,375,559 | B1 * | 4/2002 | James et al. | 451/527 |

* cited by examiner

*Primary Examiner*—Robert Rose
(74) *Attorney, Agent, or Firm*—Luedeka Neely & Graham, P.C.

(57) ABSTRACT

A polishing pad having an upper layer with a first visual characteristic. The upper layer is adapted to erode against a pad conditioner at a uniform rate during a pad conditioning process. At least one lower layer with at least a second visual characteristic is disposed beneath the upper layer. The first visual characteristic is visually distinguishable from the second visual characteristic. The at least one lower layer is adapted to polish a substrate, where the visual distinguishability between the upper layer and the at least one lower layer provides a visual indication of whether the pad conditioning process has been accomplished in a uniform manner.

20 Claims, 1 Drawing Sheet

VISUAL WEAR CONFIRMATION POLISHING PAD

FIELD

This invention relates to the field of integrated circuit fabrication. More particularly, this invention relates to tooling used in chemical mechanical polishing.

BACKGROUND

As integrated circuits have become smaller, they have shrunk not only in the amount of surface area required, but also in the thicknesses of the various layers by which they are formed. As the thicknesses of the layers has decreased, it has become increasingly important to planarize a given layer prior to forming a subsequent overlying layer. One of the methods used for such planarization is called chemical mechanical polishing. During chemical mechanical polishing, the surface of the layer to be planarized, thinned, or both is brought into contact with the surface of a polishing pad. The pad and the substrate are rotated and translated relative to each other in the presence of a polishing fluid, which typically contains both physical erosion particles and chemical erosion compounds. Because of the thinness of the layers and the tight tolerances desired, it is important to have a relatively high degree of control over the chemical mechanical polishing process.

One method by which control of the chemical mechanical polishing process is maintained is called conditioning. During conditioning, an implement called a conditioner is brought into contact with the surface of the pad. The conditioner is intended to erode the surface of the pad, so as to expose a portion of the pad that is presumptively more uniform and clean. By this it is meant that the newly exposed portion of the pad is preferably free from surface defects, non-uniformities, and impregnated by-products of the process. Conditioning the pad may be accomplished either between substrate polishing processes, or concurrently with the polishing process. Conditioning tends to generally improve important process characteristics such as substrate to substrate repeatability, polish rate stability, pad life, down time, and overall cost of system ownership.

When a new pad is placed into service, the pad is typically processed with a break in period, during which a more aggressive pad conditioning is performed. Following the break in period, test wafers are processed and checked, and then a standard pad conditioning is accomplished, during which about a tenth of a mil is typically removed from the surface of the pad by the conditioner.

Because the conditioner performs such an important function, it is commensurately important to ensure that the conditioner is functioning properly. Such methods have in the past included a visual inspection of the conditioner, a "fish scale" force monitor, removing the conditioner and performing a flatness test against a known flat standard, and regularly rebuilding or replacing the conditioner. If the conditioner is miss-aligned, worn out, or warped, then it might not make complete and uniform contact with the pad. Such poor pad conditioning might result in poor processing uniformity across a substrate or from substrate to substrate, shorter pad life, increased down time, and other expenses due to yield loss.

Unfortunately, it is very difficult to detect whether the pad conditioner is performing properly, except by the dramatic indicators given above, such as short pad life and wafer non uniformity. Thus, in an extreme condition, a pad conditioner may need to be removed and completely set up anew each day, to ensure that it is in good condition and operating properly. However, this is an expensive and time-consuming process, and opens the door for mistakes to be made during the frequently repeated set up process.

What is needed, therefore, is a system by which proper pad conditioning can be more readily determined.

SUMMARY

The above and other needs are met by a polishing pad having an upper layer with a first visual characteristic. The upper layer is adapted to erode against a pad conditioner at a uniform rate during a pad conditioning process. At least one lower layer with at least a second visual characteristic is disposed beneath the upper layer. The first visual characteristic is visually distinguishable from the second visual characteristic. The at least one lower layer is adapted to polish a substrate, where the visual distinguishability between the upper layer and the at least one lower layer provides a visual indication of whether the pad conditioning process has been accomplished in a uniform manner.

In this manner, the uniformity of a process, such as the conditioning process, can be visually determined. As the upper layer is eroded away during the process, the lower layer will begin to appear through the eroded portions of the upper layer. Because the upper and lower layers have characteristics that are visually distinguishable, it is possible to determine the lower layer from the upper layer in those eroded portions. Thus, process characteristics such as the sweep and uniformity of the pad conditioner, and the removal rate of the upper and lower layers can be visually detected.

In various preferred embodiments, the first visual characteristic and the second visual characteristic are at least one of color and texture. Preferably, the at least one lower layer is a plurality of interleaved first layers and second layers, and adjacent first and second layers are visual distinguishable one from another. In one embodiment, the at least one lower layer is a plurality of interleaved first layers and second layers, where the second visual characteristic is associated with each of the second layers and a third visual characteristic is associated with each of the first layers. The second and third visual characteristics are preferably visually distinguishable one from another.

The at least one lower layer preferably includes about fifty layers. There is preferably a backing disposed below the at least one lower layer, and an adhesive layer disposed below the backing. The upper layer and the at least one lower layers are preferably no more than about three mils in thickness.

According to another aspect of the invention there is described a method of visually determining the effects of conditioning on a polishing pad. A polishing pad as described above is provided. The polishing pad is conditioned with a polishing pad conditioner, and the effects of the conditioning on the polishing pad are inspected by visually determining wear patterns on the polishing pad. The wear patterns are indicated by contour lines between the first visual characteristic and the at least one second visual characteristic.

BRIEF DESCRIPTION OF THE DRAWINGS

Further advantages of the invention are apparent by reference to the detailed description when considered in conjunction with the figures, which are not to scale so as to more clearly show the details, wherein like reference numbers indicate like elements throughout the several views, and wherein.

DETAILED DESCRIPTION

Figure 1:
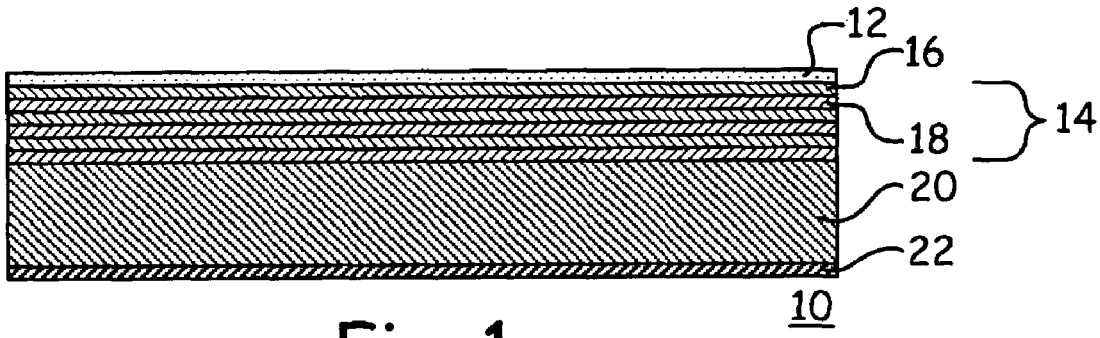
FIG. 1 is a cross sectional view of a portion of a polishing pad according to a preferred embodiment of the present invention.

With reference now to FIG. 1, there is depicted a cross sectional view of a portion of a polishing pad 10 according to a preferred embodiment of the present invention. Depicted in FIG. 1 is an upper layer 12 having a first visual characteristic, which in the preferred embodiment is at least one of color and texture. Disposed below the upper layer 12 are at least one lower layer 14, such as interleaved first lower layers 16 and second lower layers 18. Preferably, the lower layers 14 have at least a second visual characteristic that is visually distinguishable from the first visual characteristic of the upper layer 12. The second characteristic is also preferably at least one of color and texture.

Most preferably, adjacent ones of the interleaved first lower layers 16 and the second lower layers 18 have at least one visual characteristic that is different one from another, so that adjacent layers, at least, are visually distinguishable one from the other. In a simple embodiment, this could be a visual characteristic such as alternating color, where all of the first lower layers 16 are white, for example, and all of the second lower layers 18 are black. Alternately, each lower layer 14 could be at least a slightly different color one from another, or have a texture that is distinguishable from any other lower layer 14.

Most preferably, the upper layer 12 and the lower layers 14 are backed by a backing layer 20, which is adapted to provide mechanical strength and support to the upper layer 12 and the lower layers 14. An adhesive layer 22 is preferably provided beneath the backing layer 20, so that the polishing pad 10 can be affixed to the turntable or other elements of the equipment in which it functions.

Figure 2:
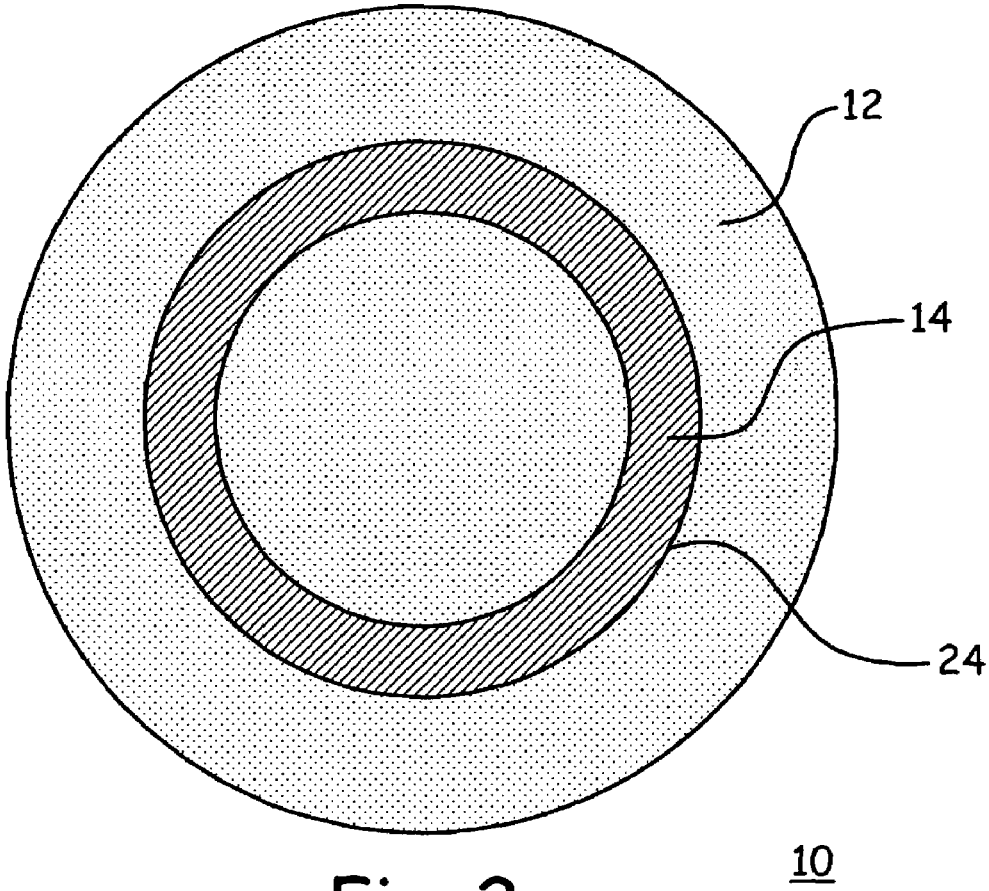
FIG. 2 is a top plan view of a polishing pad according to a preferred embodiment of the present invention.

The layers 12 and 14 of the pad 10 are each preferably as much as about three mils in thickness, and most preferably are about one mil in thickness. Thus, as the upper layer 12 is worn away, the uppermost first lower layer 16 is visible through the upper layer 12, which situation is visually detectable because the upper layer 12 is visually distinguishable from any of the lower layers 14, as described above, and as depicted in FIG. 2, which is a simple representation of a wear pattern 24 on a polishing pad 10.

Thus, with such a pad 10 as described above, the effects of conditioning on the pad 10 can be readily and visually identified, according to the wear patterns 24 visible from the top surface of the pad 10. In the simple example depicted in FIG. 2, there is uneven and excessive wear in the track 24 of the pad 10. Preferably, the upper layer 12 would wear through in a more uniform manner across the entire surface of the pad 10.

Preferably, the upper layer 12 is adapted to be removed during a preconditioning procedure for the pad 10, and the lower layers 14 are adapted for polishing substrates. As the pad 10 is eroded during the substrate polishing processes, the wear patterns in the pad 10 can be visually identified by the various lower layers 14 which are exposed to the top surface of the pad 10. Because the first and second lower layers 16 and 18 preferably have visual characteristics whereby adjacent layers can be visually distinguished one from another, such wear patterns will tend to exhibit contour lines at their peripheral edges. Thus, the degree of the non uniformity of wear will also be visually evident by counting contour lines at the edge of a wear pattern. Further, the severity of such shifts in the non uniformity of wear is also visually evident by the width of adjacent contour lines at the edge of a wear pattern.

In this manner, the uniformity of a process, such as the conditioning process or the polishing process, can be visually determined. As the upper layer is eroded away during the process, the lower layer will begin to appear through the eroded portions of the upper layer. Because the upper and lower layers have characteristics that are visually distinguishable, it is possible to determine the lower layer from the upper layer in those eroded portions. Thus, process characteristics such as the sweep and uniformity of the pad conditioner, the removal rate of the upper layer, and the uniformity of the polishing process can be visually detected.

The foregoing description of preferred embodiments for this invention have been presented for purposes of illustration and description. They are not intended to be exhaustive or to limit the invention to the precise form disclosed. Obvious modifications or variations are possible in light of the above teachings. The embodiments are chosen and described in an effort to provide the best illustrations of the principles of the invention and its practical application, and to thereby enable one of ordinary skill in the art to utilize the invention in various embodiments and with various modifications as is suited to the particular use contemplated. All such modifications and variations are within the scope of the invention as determined by the appended claims when interpreted in accordance with the breadth to which they are fairly, legally, and equitably entitled.

What is claimed is:

1. A polishing pad comprising:

at least two first layers having a first visual characteristic, the first layers adapted to polish a substrate, and at least two second layers having at least a second visual characteristic, where the first visual characteristic is visually distinguishable from the second visual characteristic, the second layers adapted to polish the substrate, the at least two first layers interleaved with the at least two second layers, where the visual distinguishability between the at least two first layers and the at least two second layers provides a visual indication of pad erosion.

2. The polishing pad of claim 1, wherein the first visual characteristic and the second visual characteristic are color.

3. The polishing pad of claim 1, wherein the first visual characteristic and the second visual characteristic are texture.

4. The polishing pad of claim 1, wherein the first visual characteristic is a white color and the second visual characteristic is a black color.

5. The polishing pad of claim 1, wherein there are an equal number of first and second layers.

6. The polishing pad of claim 1, wherein the polishing pad includes a total of about fifty interleaved first and second layers.

7. The polishing pad of claim 1, further comprising a backing disposed below the interleaved first and second layers.

8. The polishing pad of claim 1, further comprising an adhesive layer disposed below the interleaved first and second layers.

9. The polishing pad of claim 1, wherein each of the interleaved first and second layers is no more than about three mils in thickness.

10. The polishing pad of claim 1, wherein each of the interleaved first and second layers is no more than about one mil in thickness.

11. A polishing pad comprising:

at least two first layers having a first visual characteristic, the first layers adapted to polish a substrate, at least two second layers, the second layers having a second visual characteristic, where the first visual characteristic is visually distinguishable from the second visual characteristic, the second layers adapted to polish the substrate, the at least two first layers interleaved with the at least two second layers, where the visual distinguishability between the interleaved first and second layers provides a visual indication of pad erosion, a backing disposed below the plurality of interleaved first and second layers, and an adhesive layer disposed below the backing.

12. The polishing pad of claim 11, wherein the first visual characteristic and the second visual characteristic are color.

13. The polishing pad of claim 11, wherein the first visual characteristic and the second visual characteristic are texture.

14. The polishing pad of claim 11, wherein the first visual characteristic is a white color and the second visual characteristic is a black color.

15. The polishing pad of claim 11, wherein the interleaved first and second layers comprise a total of about fifty layers.

16. The polishing pad of claim 11, wherein there are an equal number of first and second layers.

17. The polishing pad of claim 11, wherein each of the interleaved first and second layers is about one mil in thickness.

18. A polishing pad, comprising:

at least two white layers adapted to polish a substrate, and at least two black layers adapted to polish the substrate, wherein the white layers are interleaved with the black layers.

19. The polishing pad of claim 18, wherein the layers are no more than about three mils in thickness.

20. The polishing pad of claim 18, wherein the layers are no more than about one mil in thickness.

* * * * *